US006874700B2

(12) United States Patent
Ham et al.

(10) Patent No.: US 6,874,700 B2
(45) Date of Patent: Apr. 5, 2005

(54) CONTAMINATION CONTROL METHOD AND APPARATUS, AND AIR-CONDITIONING SYSTEM OF A SUBSTRATE PROCESSING FACILITY EMPLOYING THE SAME

(75) Inventors: Dong-Seok Ham, Suwon (KR); Hyun-Joon Kim, Anyang (KR); Hyun-Ho Cho, Suwon (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 10/684,439

(22) Filed: Oct. 15, 2003

(65) Prior Publication Data

US 2004/0124271 A1 Jul. 1, 2004

(30) Foreign Application Priority Data

Dec. 5, 2002 (KR) ..... 10-2002-0077064

(51) Int. Cl.[7] ..... B05B 9/00
(52) U.S. Cl. ..... 239/127; 4/213
(58) Field of Search ..... 239/127, 93; 4/213, 4/216, 220, 209 F, 209 R

(56) References Cited

U.S. PATENT DOCUMENTS 6,643,850 B2 * 11/2003 Chasen et al. ..... 4/213

FOREIGN PATENT DOCUMENTS

| | | |
|---|---|---|
| JP | 11-74168 | 3/1999 |
| JP | 11-74193 | 3/1999 |

* cited by examiner

*Primary Examiner*—David A. Scherbel
*Assistant Examiner*—Thach H. Bui
(74) *Attorney, Agent, or Firm*—Volentine Francos & Whitt, P.L.L.C.

(57) ABSTRACT

A contamination control apparatus has a sprayer including at least one nozzle for spraying water, at least one eliminator having a passageway in which air is sprayed with the water to remove potential contaminants from the air, and a circulator for providing the sprayer with the water. The circulator includes a pH control device for adjusting the pH of the water fed to the sprayer, and an organic matter removing device for removing organic matter from the water. The contamination control apparatus can be advantageously employed in an air-conditioning system of a substrate processing facility.

38 Claims, 10 Drawing Sheets

CONTAMINATION CONTROL METHOD AND APPARATUS, AND AIR-CONDITIONING SYSTEM OF A SUBSTRATE PROCESSING FACILITY EMPLOYING THE SAME

BACKGROUND OF THE INVENTION

1. Field of the Invention

The present invention relates to controlling contamination in the processing of substrates, such as during the manufacturing of semiconductor devices. More specifically, the present invention relates to a contamination control apparatus and to an air-conditioning system of a substrate processing facility employing the same.

2. Description of the Related Art

In the manufacturing of semiconductor devices, various contaminants have caused many problems such as limiting the yield of the semiconductor devices, adversely affecting the reliability of the semiconductor devices, and creating failures in the processing of the substrates from which the devices are made. The reliability and yield of the semiconductor devices is greatly affected particularly when the manufacturing environment contains contaminants in an amount as low as several parts per million. Recently, as the circuit patterns of semiconductor devices have become even more minute, air-bone molecular contamination (AMC) as well as general particulate contaminants have caused serious problems. For example, the presence of ozone ($O_3$) in the manufacturing environment has formed undesired native oxide films on the substrates, while the presence of ammonia ($NH_3$) has produced undesired variations in the desired profile and critical dimension (CD) of photoresist patterns that are formed on the substrates. Additionally, the ammonia can create a haze on an optical system for use in processing the substrates, while organic matter may affect the surface characteristics of the substrates (wafers).

Therefore, a semiconductor manufacturing process is performed in a highly clean atmosphere. That is, semiconductor device manufacturing apparatus are installed in a clean room and a clean air supply apparatus is connected to the clean room. Generally, the clean air supply apparatus includes fan and filter unit (FFU) comprising a fan, a filter integrated with the fan, and cover enclosing the integrated fan and filter. The clean air supply apparatus provides clean air into the clean room where the semiconductor manufacturing apparatus are disposed.

Furthermore, the clean air supply apparatus also includes a chemical filter for removing contaminants in the air such as ozone, ammonia, sulfuric oxide ($SO_x$), nitrous oxide ($NO_x$) and organic matter. However, such chemical filters have a relatively short lifetime and are considerably expensive. Thus, the costs of running the semiconductor device manufacturing apparatus are augmented by the need to frequently replace the chemical filter of the clean air supply apparatus, thereby in turn raising the cost of manufacturing the semiconductor devices. In addition, several different kinds of chemical filters are often used for filtering out the various contaminants that can affect the manufacturing process. Therefore, the maintenance and management of the clean air supply apparatus is expensive. Moreover, the use of a number of chemical filters makes processing failures more likely to occur. Still further, the clean air supply apparatus must be adapted to employ a new type of chemical filter whenever a new type of contaminant is generated during the semiconductor manufacturing processes.

Methods of and apparatus for removing contaminants from the air without the use of chemical filters have been developed in consideration of the above-mentioned problems. For example, Korean Patent Laid-Open Publication No. 2002-22331, Korean Patent Laid-Open Publication No. 1998-87295 and Japanese Patent Laid-Open Publication No. 10-67644 each disclose a water showering system for spraying the air with water to remove the contaminants from the air. FIG. 1 is a schematic cross-sectional view of such a conventional water showering system.

Referring to FIG. 1, the conventional water showing system includes a sprayer 10, an eliminator 20 and a tank 25. The sprayer 10 has a plurality of nozzles for spraying water, preferably deionized (D.I.) water, as minute water droplets into the eliminator 20. The water droplets collide with plates of the eliminator 20 and fall to the bottom of the eliminator 20. The tank 25 receives the water droplets, which accumulate to form a pool of water in the tank 25. The water is continuously supplied back into the sprayer 10 by a pump (not shown) via a filter 30. Air (Ai) containing contaminants is into introduced into the water showering system. The water is rapidly sprayed through the nozzles of the sprayer 10 onto the air (Ai) in the eliminator 20, and is thus cleaned. The cleaned air (Ao) is exhausted from the water showering system. In FIG. 1, phantom lines indicate the flow of the air and the solid lines represent the flow of the water.

According to the conventional water showering system, the water droplets sprayed from the nozzles absorb the contaminants suspended as dust in the air. As the water droplets absorb more and more of the contaminants, the water in the tank 25 becomes more contaminated. Hence, the ability of the water showering system to remove the contaminants rapidly decreases over time as the water is continuously polluted. In order to ensure that the contaminants are removed with a high degree of efficiency, the tank 25 is continuously refreshed with an additional amount of water of more than about 90 percent of the entire amount of water contained in the water showering system. As a result, the pH of the water is maintained and the water is prevented from becoming excessively contaminated. However, refreshing the tank 25 with additional water seriously increases the load on the pump 30 and increases the operation costs of the system. On the contrary, if water is not added to the tank 25, the pH of the water is quickly altered, whereby hardly any of the contaminants can be removed by the water. Thus, this conventional water showering system is not suitable for use in an air-conditioning system of a substrate processing facility for manufacturing semiconductor devices.

SUMMARY OF THE INVENTION

In accordance with one aspect of the present invention, a contamination control apparatus has a sprayer including at least one spray nozzle, at least one eliminator defining an air flow passageway exposed to the at least one spray nozzle, and a circulator connected to the sprayer so as to feed water to the sprayer. The circulator includes a pH control device, and an organic matter removing device.

Primary air from outside the processing chamber, and containing potential contaminants with respect to the processing of a substrate, is fed into the passageway to create a flow of the air in the passageway. The flow of air is sprayed with the water from the at least one spray nozzle, whereby the water absorbs contaminants in the air. The pH control device measures the pH of the water before it is fed to the at least one spray nozzle, and adjusts the pH of the water if the measured pH is outside a set range. The water is also treated by the organic matter removing device, before it is fed to the at least one spray nozzle, to remove organic matter from the water before it is sprayed onto the flow of air. Finally the cleaned air is directed into a substrate processing chamber sealed from the environment external to the chamber.

The basic contamination control system can be modified to enhance the efficiency thereof. For instance, the passageway of the eliminator may have a bend to extend the amount of time that the water contacts the contaminants in the air. Alternatively, at least two eliminators may be disposed in series. In still another embodiment, at least two eliminators are disposed in parallel to create a vortex in the air. Another embodiment includes at least one additional water supply nozzle for spraying water into the eliminator.

According to another aspect of the present invention, the contamination control apparatus is incorporated into an air-conditioning system of a substrate processing facility having a clean room. The air-conditioning system has an air supply pipe for introducing primary air from the clean room into the eliminator of the contamination control apparatus.

A control unit is also provided for controlling at least one of the temperature and the moisture content of the air cleaned by the contamination control apparatus. A clean air supply pipe provides the clean air into a chamber in which substrates are processed within the clean room.

In accordance with still another aspect of the present invention, the contamination control apparatus is incorporated into an external air-conditioning system of a substrate processing facility having a clean room. In this case, a clean air supply duct extends from the contamination control apparatus into the clean room and is connected to the processing chambers of substrate processing apparatuses situated in the clean room. Accordingly, the air cleaned by the contamination control apparatus is supplied to the substrate processing apparatuses. In addition, a filter is disposed in the duct so as to filter the clean air flowing from the contamination control apparatus to the substrate processing apparatuses.

The contamination control apparatus of present invention can simultaneously remove various contaminants from air, such as ozone, ammonia, sulfuric oxide, nitrous oxygen and organic matter, without the need for expensive and consumable filters. Additionally, the contamination control apparatus controls the pH of the water used to remove the contaminants from the air, and removes organic matter from the water, so that all of the contaminants are removed with a high degree of efficiency. Therefore, processing failures otherwise caused by the contaminants can be prevented. As a result, the present invention helps to improve the manufacturing yield and reliability of the semiconductor devices.

BRIEF DESCRIPTION OF THE DRAWINGS

The above and other advantages of the present invention will become more apparently from the following detailed description of the preferred embodiments thereof made with reference to the accompanying drawings, in which.

DETAILED DESCRIPTION OF THE PREFERRED EMBODIMENTS

Figure 1:
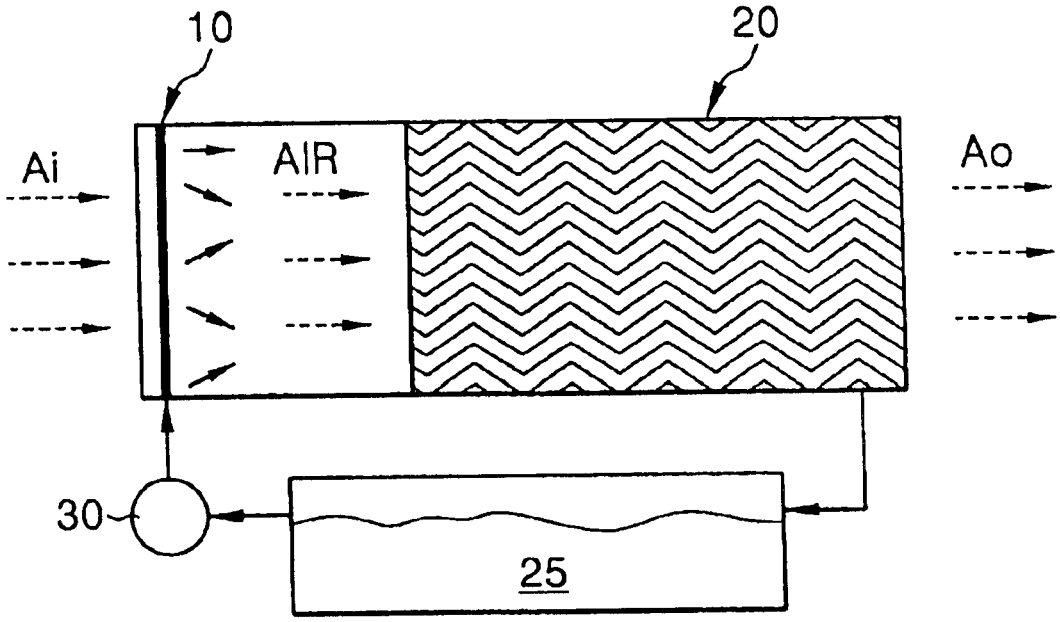
FIG.1 (PRIOR ART)
FIG. 1 is a schematic cross-sectional view of a conventional water spray system.

Hereinafter, the preferred embodiments of the present invention will be described in detail with reference to the accompanying drawings. Note, like reference numerals designate like elements throughout the drawings.

Figure 2:
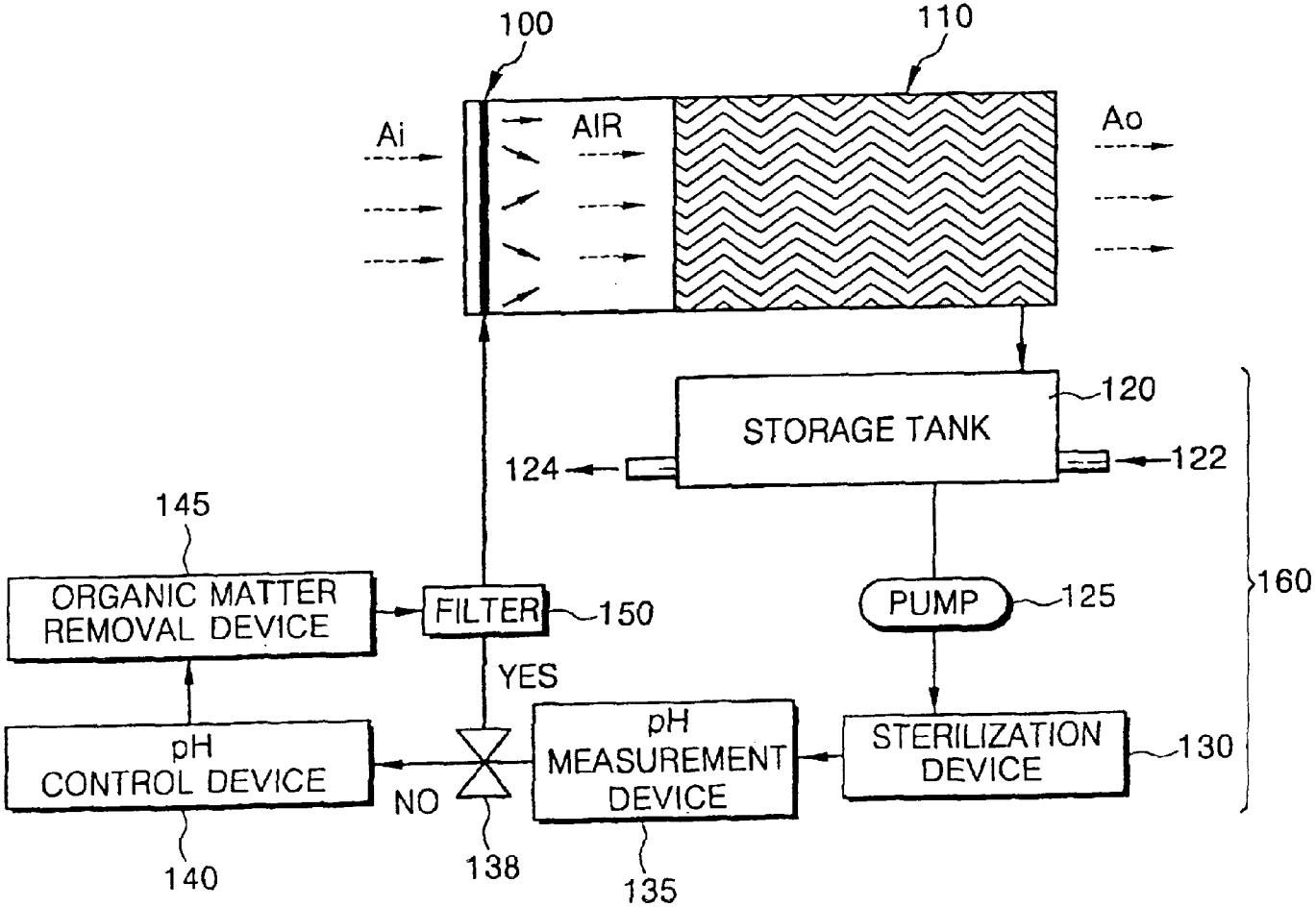
FIG. 2 is a schematic cross-sectional view of one embodiment of a contamination control apparatus according of the present invention.

Referring first to FIG. 2, a contamination control apparatus of the present invention generally includes a sprayer 100, an eliminator 110 and a circulator 160.

The sprayer 100 includes at least one nozzle configured to spray water into the eliminator 110 as minute water droplets. The water may be city water, industrial water or well water. Preferably, though, deionized water is employed for quality control. Incoming air (Ai) passes through the eliminator 110. The size of the water droplets provided by the sprayer 100 depends mainly on the size of the openings of the nozzle and the pressure of the water supplied to the nozzle. In the present embodiment, the size of the openings of the nozzle (s) and the pressure of the water supplied to the nozzle(s) are designed for in accordance with the size or type of the contaminants in the air (Ai). Also, the smaller the water droplets are, the greater is the surface area collectively presented to the air (Ai) by the water droplets. The size of the water droplets is thus tailored to provide for a desired absorption efficiency. Specifically, the water droplets preferably have a size (diameters) of below about 100 $\mu$m. In FIG. 2, the phantom arrows indicate the flow of the incoming air stream, and the solid arrows indicate the flow of the water sprayed from the nozzle(s) of the sprayer 100.

The water droplets catch contaminants in the air in the eliminator 110. Then, the water droplets containing the contaminants collide with plates of the eliminator 110, whereupon the water droplets fall to the bottom of the eliminator 110. The eliminator 110 can be manufactured of plastic or stainless steel. Preferably, the plates of the eliminator 110 are porous. The pores of adjacent ones of the plates are offset from one another in the direction of flow of the air (Ai) and water spray. Hence, any water droplets containing contaminants that do not collide with an upstream one of the porous plates is likely to collide with a downstream one of the porous plates.

The air (Ao) cleaned in the eliminator 110 is exhausted from the contamination control apparatus.

The circulator 160 includes a storage tank 120, and a circulation pump 125 coupled to the storage tank 120 for controlling the amount of water circulated in the system. The water droplets containing the contaminants at the bottom of the eliminator 110 drain into the storage tank 120.

As the water droplets from the eliminator 110 pool in the storage tank 120, the vapor pressure of the water increases in the tank 120. That is, water molecules evaporate from the surface of the water in the storage tank 120. According to the present invention, additional water is supplied into the storage tank 120 through a water supply pipe 122 connected to the storage tank 120 to compensate for the evaporated water. In addition, a predetermined amount of the water received in the storage tank 120 is discharged from the storage tank 120 through a discharge pipe 124 connected to another portion of the storage tank 120 to maintain the water at a certain level in the storage tank 120.

The circulation pump 125 pumps the water received in the storage tank 120 back to the sprayer 100. The circulator 160 additionally includes a potential of hydrogen (pH) measuring device 135, a pH control device 140 and an organic matter removing device 145, and a directional control valve 138.

The pH measuring device 135 measures the pH of the water flowing from the storage tank 120 to the sprayer 100 (hereinafter referred to as "circulating water'). The circulating water is supplied to the sprayer 110 as long as the measured pH of the circulating water is within a predetermined range. On the contrary, when the measured pH of the circulating water deviates from the set range, the valve 138 is operated to provide the circulating water into the pH control device 140.

The pH control device 140 adjusts the pH of the circulating water to within a predetermined range. The pH control device 140 preferably comprises an ion exchanger having an ion exchange material that exchanges ions with the circulating water to control the pH of the circulating water.

The water is supplied to the organic matter removing device 145 after the pH control device 140 adjusts the pH of the circulating water. The organic matter removing device 145 removes organic matter from the circulating water so as to improve the quality of the circulating water. The organic matter removing device 145 includes a member of an organic resin.

The efficiency by which contaminants are removed in a wet air-conditioning contaminant control apparatus is mainly determined by factors such as the pH and quality (purity) of the water. In the conventional contaminant control apparatus shown in FIG. 1, the quality of the water and the pH of the water degrade as the water continuously circulates through the system. However, in the contaminant control apparatus of the present invention, the pH control device 140 maintains the pH of the water circulated through the system by the circulator 160, thereby preventing the efficiency of the system from deteriorating over time. In addition, the organic matter removing device 145 removes organic matter from the circulating water so that the quality of the water is maintained.

Figure 3A:
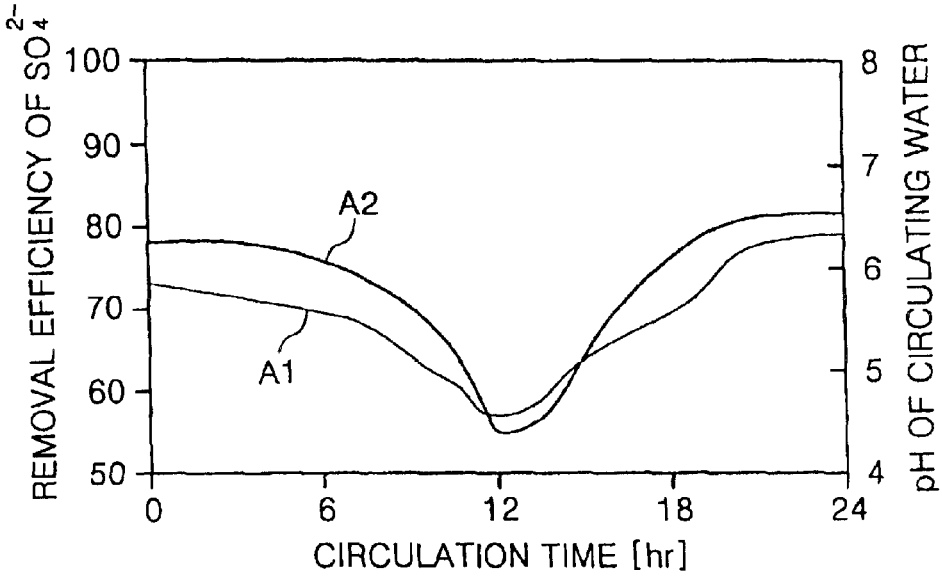
FIGS. 3A and 3B are graphs illustrating the change in efficiency of a water showering contamination control apparatus as the pH of the water in the apparatus changes over time.
Figure 3B:
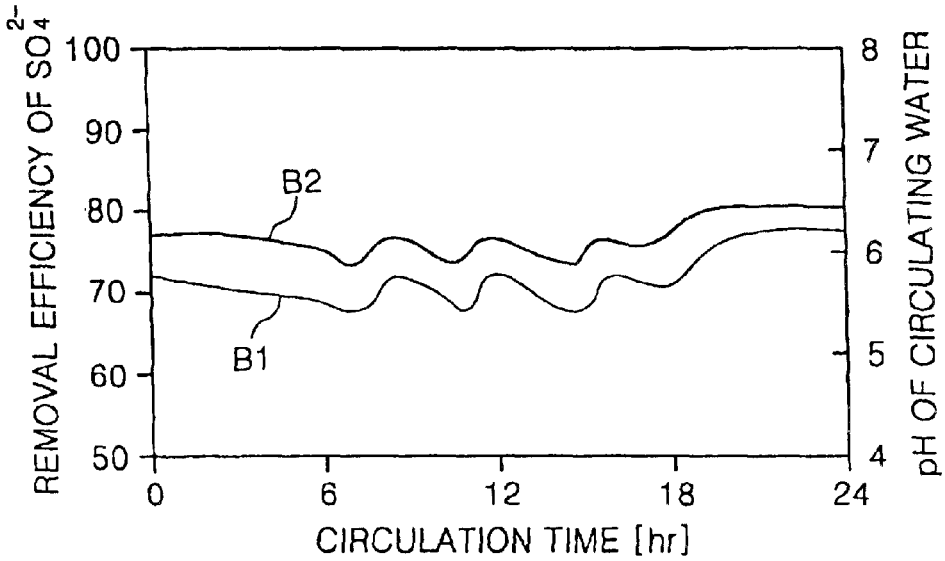

FIGS. 3A and 3B are graphs illustrating the relationship between the pH of water (A1) and the efficiency of the contamination control apparatus (A2) in removing ions of sulfuric acid ($SO_4^{-2}$) as the water circulates through the apparatus over a long period of time. As shown in FIG. 3A, the efficiency of the apparatus in removing the sulfuric acid ions can decrease over time if the pH of the water circulated in the system is allowed to decrease. On the contrary, as shown in FIG. 3B, the efficiency of the apparatus (B2) in removing sulfuric acid ions is maintained when the pH of the water (B1) circulated in the system is maintained.

Referring now back to FIG. 2, the circulator 160 also includes a sterilization device 130 and a filter 150. The sterilization device 130 sterilizes the circulating water to kill microorganisms, germs or bacteria existing in the water. Such microorganisms, germs and bacteria may multiply in the water in the storage tank 120 because the water can remain in the storage tank 120 for a somewhat long amount of time. Preferably, the sterilization device 130 includes a source of U.V. radiation for irradiating the water in the tank 120 with U.V. light.

In the conventional contamination control apparatus, the pH of the circulating water is reduced as the water is continuously circulated through the apparatus. Therefore, a great deal of additional water must be supplied into the storage tank of the conventional contamination control apparatus to maintain the efficiency of the system. In fact, about 90 percent of the water in the storage tank is replaced. However, as was described earlier, this operation greatly increases the cost of running the apparatus.

On the other hand, according to the present invention, the pH of the circulating water is constantly maintained by the pH measuring device 135 and the ph control device 140. The storage tank 120 needs to be replenished with water in an amount of only less than about 10 percent of the total amount of water that is fed into the tank 120. Therefore, the present invention is less costly to operate and produces less waste water than the prior art.

Also, the present embodiment of the contamination control apparatus removes contaminants including ammonia ($NH_3$) with an efficiency of about 81 percent, and contaminants including $NO_x$ with an efficiency of about 64 percent. Additionally, the contamination control apparatus removes contaminants including $SO_x$ with an efficiency of about 88 percent. Furthermore, the present embodiment of the contamination control apparatus removes organic matter and contaminants including ozone ($O_3$) with efficiencies of about 50 percent and about 20 percent, respectively. The contamination control apparatus can be used for a long period of time as is because the efficiencies of the apparatus as outlined above do not deteriorate over time. Therefore, the maintenance costs and management expenses of the apparatus are relatively low.

Figure 4A:
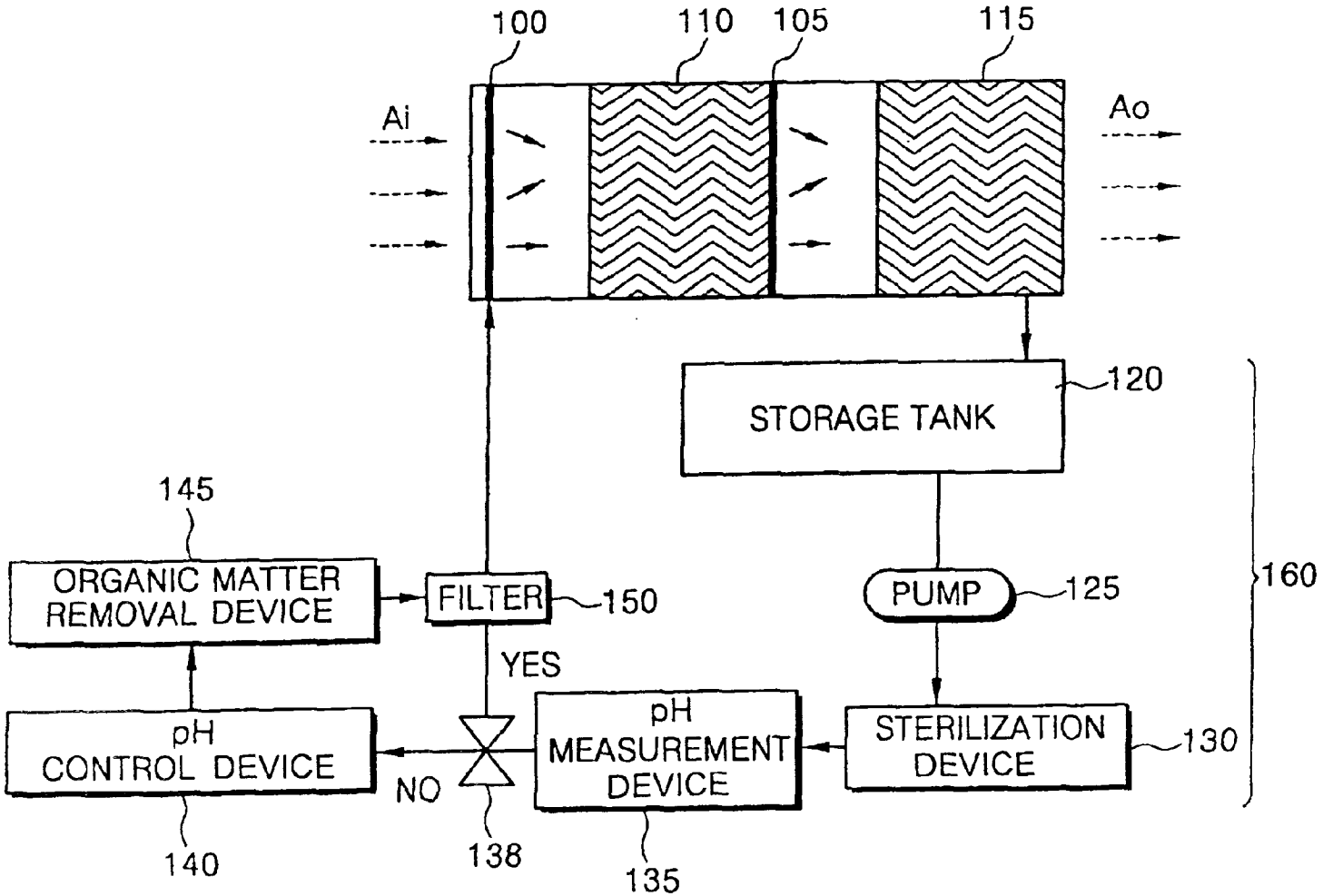
FIG. 4A is a schematic cross-sectional view of another embodiment of a contamination control apparatus according to the present invention.

FIG. 4A shows another contamination control apparatus according to the present invention includes at least two eliminators and two sprayers. That is, the contamination control apparatus includes a first sprayer 100, a first eliminator 110, a second sprayer 105, a second eliminator 115 and a circulator 160. The eliminators 110 and 115 are disposed in series to provide for even a higher rate of efficiency in removing contaminants from the air (Ai).

Water circulated by the circulator 160 is simultaneously supplied to the first and second sprayers 100 and 105. The air (Ai) is introduced into the contamination control system and passes through the first and second eliminators 110 and 115. After the contaminants in the air (Ai) are removed in the first and second eliminators 110 and 115 by the water droplets issuing from the first and second sprayers 100 and 105, the cleaned air (Ao) is exhausted from the contamination control apparatus.

The other elements of the contamination control apparatus are the same as those of the first embodiment described above.

Figure 4B:
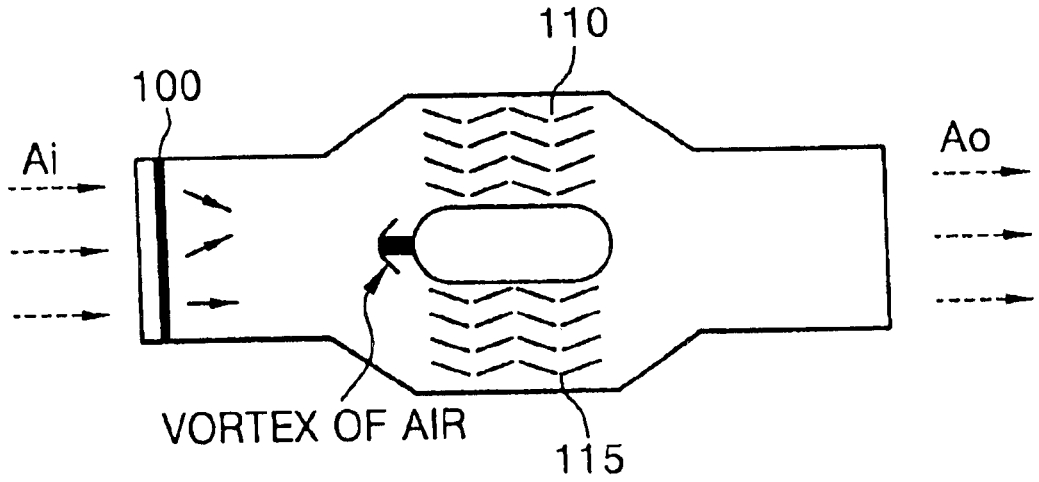
FIG. 4B is a schematic cross-sectional view of still another embodiment of a contamination control apparatus according to the present invention.

Alternatively, as shown in FIG. 4B, at least two eliminators 110 and 115 may be disposed in parallel to create a vortex in the flow of air (Ai) introduced into the contamination control system. The vortex of the air (Ai) is formed between the two eliminators 110 and 115. The swirling of the air (Ai) produced between the eliminators 110 and 115 allows the water droplets issuing from the sprayer 100 to make contact with contaminants in the air (Ai) for a relatively long time. Accordingly, the efficiency of the apparatus in removing contaminants from the air (Ai) is considerably enhanced.

Figure 4C:
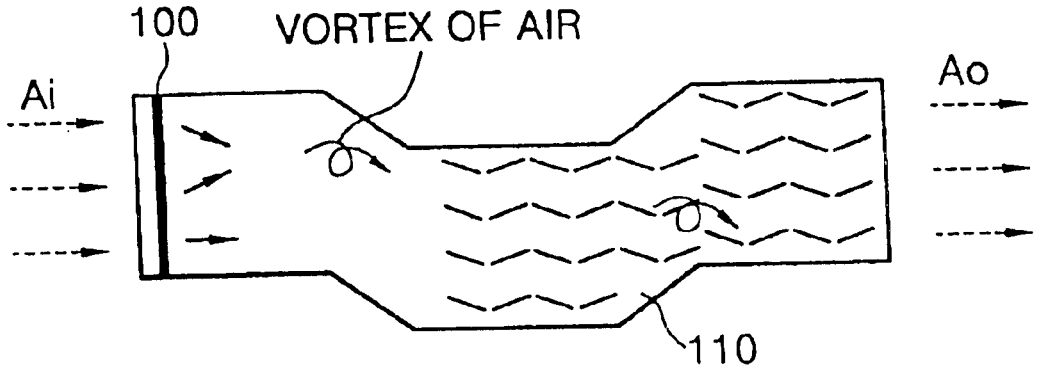
FIG. 4C is a schematic cross-sectional view of still another embodiment of a contamination control apparatus according to the present invention.

In another embodiment shown in FIG. 4C, the contamination control apparatus includes an eliminator 110 having a bend in the air passageway (U-shaped) defined thereby to generate a vortex of in the air (Ai) introduced into the contamination control apparatus. The vortex is formed in the bend of the eliminator 110 while the air (Ai) passes therethrough. Thus, water droplets issuing from the sprayer 110 contact the contaminants in the air (Ai) for a long period of time. Accordingly, the efficiency of this apparatus in removing contaminants from the air (Ai) is also considerably enhanced by the eliminator.

Figure 5:
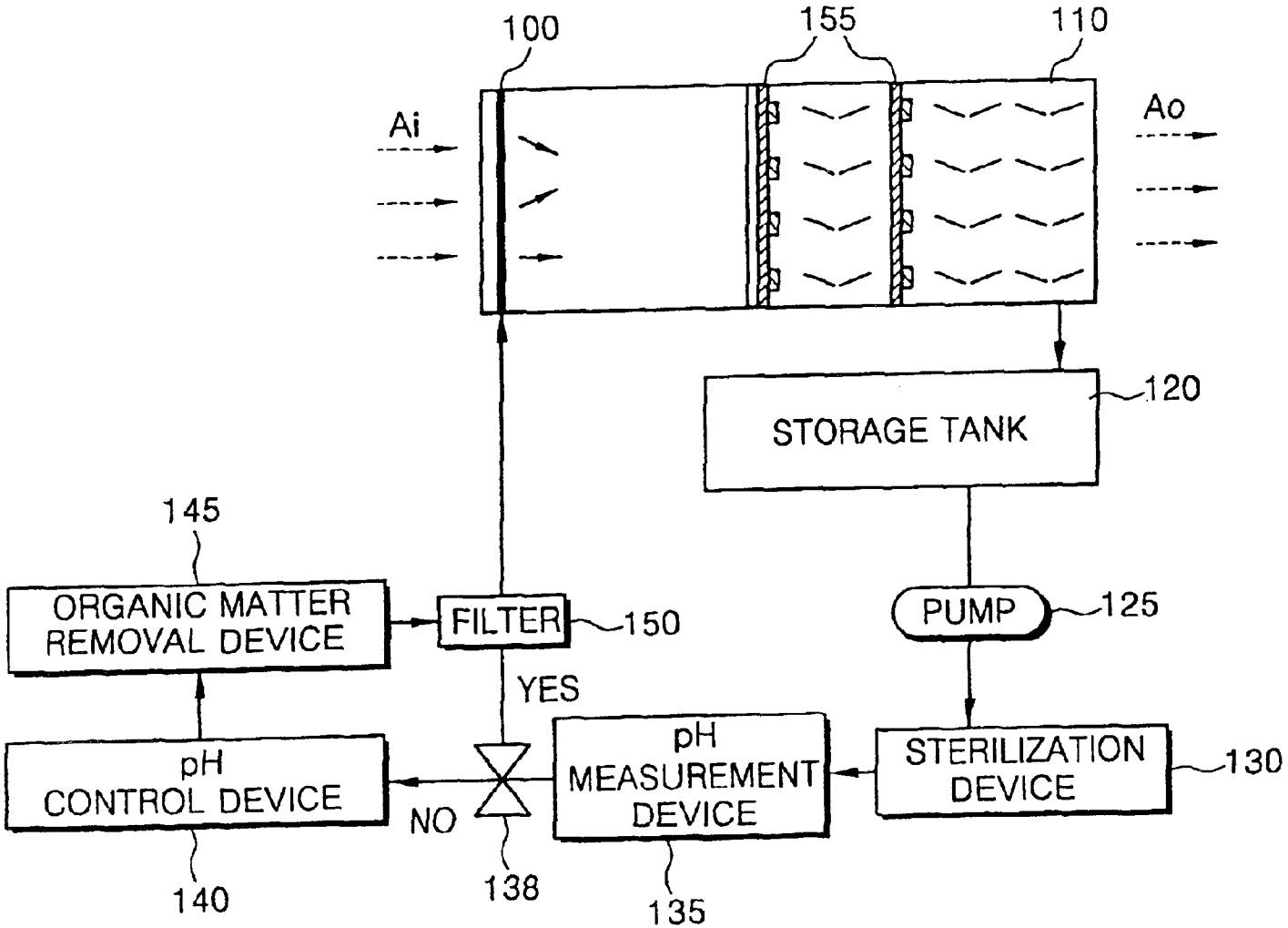
FIG. 5 is a schematic cross-sectional view of still another embodiment of a contamination control apparatus according to the present invention.

FIG. 5 illustrates still another embodiment of a contamination control apparatus according to the present invention. In this embodiment, the contamination control apparatus includes at least one water supply nozzle 155 for providing a minute amount of additional water into the eliminator 110. The other elements of the apparatus are identical to those of the above-described embodiments.

The at least one water supply nozzle 155 is disposed in the eliminator 110. The water supply nozzle(s) 155 sprays the additional water, preferably deionized water, into the eliminator 110 to enhance the efficiency of the contamination control system. The additional water sprayed into the eliminator 110 ensures that the contaminants in the air (Ai) contact water droplets, i.e., either those provided by the sprayer 100 or those additional water droplets provided by the water supply nozzle 155.

Still further, water having a hexagonal molecular structure (nano-clustered water) can be used for removing the contaminants in the air as another way to enhance the efficiency of the contamination control apparatus according to the present invention. In general, nano-clustered water has a molecular structure in which about 5 to about 7 water molecules are combined with one another. Nano-clustered water is sometimes also referred to as micro-bonded water, structured water, crystalline water, hexagonal molecular-structured water or micro-clustered water. Such nano-clustered water presents a larger surface area than do the molecules of common water. Hence, nano-clustered water can absorb more contaminants by volume than can regular common water. Nano-clustered water can be made by various methods known per se, such as by electrolysis, freezing, germanium ion introduction or magnetization using an electromagnet.

Figure 6:
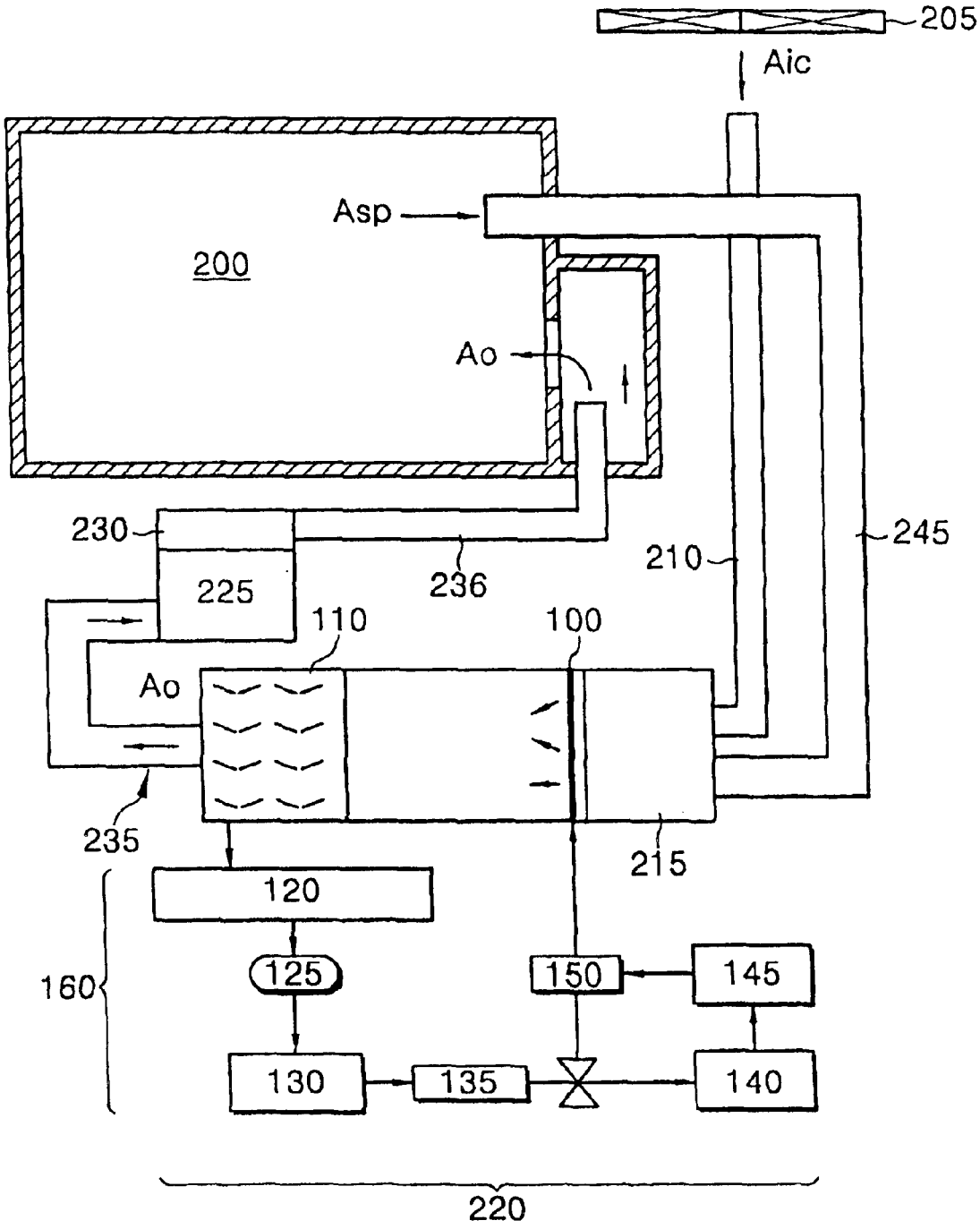
FIG. 6 is a schematic cross-sectional view of one embodiment of an air-conditioning system of a substrate processing facility according to the present invention.

Next, FIG. 6 illustrates one embodiment of an air-conditioning system of a substrate processing facility according to the present invention. The processing facility includes a semiconductor device manufacturing apparatus which, in this case, is an exposure apparatus including a scanner and a stepper for forming a resist pattern on a substrate.

Referring to FIG. 6, the air-conditioning system includes a processing chamber 200 and a contamination control apparatus 220 for providing clean air (Ao) into the processing chamber 200. The contamination control apparatus 220 has a structure similar to that of any one of the embodiments described above for removing various contaminants such as ozone ($O_3$), ammonia ($NH_3$), sulfuric oxide ($SO_x$), nitrous oxide ($NO_x$), organic matter, etc from the air. That is, the contamination control apparatus 220 includes a sprayer 100 having at least one nozzle for spraying water, an eliminator 110 in which contaminants are removed from the air by water droplets provided by the sprayer 100, and a circulator 160 for continuously providing water to the sprayer 100.

The circulator 160 includes a storage tank 120 for receiving the water containing the contaminants, a pH control device 140 for adjusting the pH of the water, and an organic matter removing device 145 for removing organic matter from the circulating water. As with the previous embodiments, adjusting the pH of the circulating water and removing organic matter from the circulating water increases the efficiency of the air-conditioning system in removing contaminants in general by about 50 percent. The circulator 160 further includes a U.V. light source 130 for sterilizing the storage tank 120. The U.V. light source 130 irradiates the circulating water with U.V. light while the contamination control apparatus is in operation. Also, in the manner described above, various means may be used to further enhance the efficiency of the contamination control apparatus: the contamination control apparatus 220 can include at least two eliminators disposed in parallel or series, can include an eliminator whose air flow passageway has a bend in it, or can utilize water having a hexagonal molecular structure (nano-clustered water).

In this air-conditioning system of the present invention, air (Aic) from a clean room is brought into the processing chamber 200 by a fan 215 after the air (Aic) passes through a filter 205 installed in the clean room. Contaminants remaining in the air (Aic) are removed by the contamination control apparatus 220. The cleaned air (Ao) is provided to a first clean air supply pipe 235. The cleaned air (Ao) passes through the first clean air supply pipe 235 to a temperature and moisture control device 225 including a temperature control unit (TCU) and a dryer wherein the temperature and moisture content (humidity) of the cleaned air (Ao) are adjusted. Then, the cleaned air (Ao) is induced into the processing chamber 200 by a fan 230 via a second clean air supply pipe 236 and a high efficient filter (such as that used in a conventional FFU) installed in the ceiling of the processing chamber 200 (not shown).

Air (Aps) in the processing chamber 200 might not include alkalis, such as ammonia ($NH_3$) or might only include a very small amount of an alkali. Therefore, the air (Aps) in the processing chamber 200 can be recycled. More specifically, the air-conditioning system additionally includes a circulation pipe 245 for allowing the air (Asp) in the processing chamber 200 to flow to the contamination control apparatus 220. After the air (Asp) is introduced from the processing chamber 200 into the contamination control apparatus 220 through the circulation pipe 245, the air (Asp) is mixed in the contamination control apparatus 220 with the air (Aic) coming from the clean room outside the processing chamber 200. Various contaminants are thus removed from this mixture of air using the contamination control apparatus 220 to form the clean air (Ao) that is provided to the processing chamber 200. The ratio of the volume of the secondary air (Asp) to that of the primary air (Aic) introduced into the contamination control apparatus 220 via the pipes 245, 210 is preferably about 8:2. That is, the primary air (Aic) makes up about 20 percent of the entire volume of air introduced into the contamination control apparatus 220, while the secondary air (Asp) passing through the circulation pipe 245 makes up about 80 percent of the entire volume of air introduced into the contamination control apparatus 220.

According to this embodiment, clean air (Ao) supplied to the processing chamber 200 by the contamination control apparatus 220 is made up of primary air (Aic) originating from outside the processing chamber 200 and secondary air (Asp) that has been recycled from the processing chamber 200. Thus, the clean air (Ao) can have a desired purity so that the processing of substrates within the chamber 200 will not fail. As a result, the process can be carried out to produce a high yield of reliable semiconductor devices.

Figure 7:
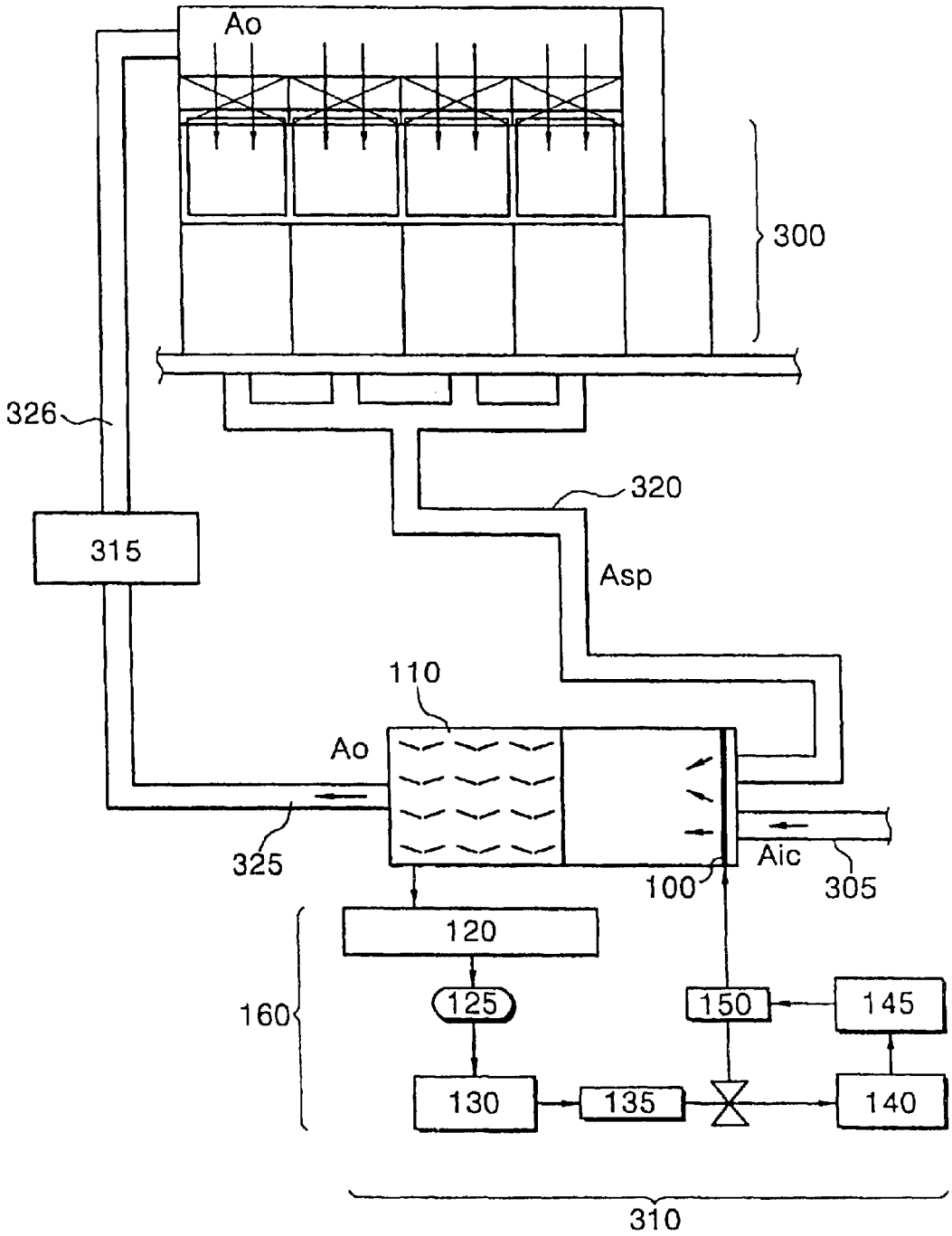
FIG. 7 is a schematic cross-sectional view of another embodiment of an air-conditioning system of a substrate processing facility according to the present invention.

FIG. 7 illustrates an air-conditioning system of another substrate processing facility according to the present invention. The semiconductor device manufacturing apparatus of this facility is a resist spinner comprising a coating device and a developing device. The air-conditioning system also basically includes a processing chamber 300, and a contamination control apparatus 310 for providing clean air (Ao) into the processing chamber 300 after removing various contaminants such as ozone, ammonia, sulfuric oxide, nitrous oxide and organic matter from the air.

The contamination control apparatus 310 has a structure identical to that of any one of the above-described embodiments. That is, the contamination control apparatus 310 includes a sprayer 100 having at least one nozzle, an eliminator 110 in which contaminants are removed from the air by water droplets issuing from the sprayer 100, and a circulator 160 for continuously providing water to the sprayer 100. Therefore, a detailed description thereof will be omitted for the sake of brevity.

The primary air (Aic) for the air-conditioning system is provided from outside the processing chamber 300 through an air supply pipe 305. Various contaminants are removed from the primary air (Aic) by the contamination control apparatus 310. The clean air (Ao) is provided from the contamination control apparatus 220 to a first clean air supply pipe 325. The cleaned air (Ao) passes through the first clean air supply pipe 325 to a temperature and moisture control device 315 including a TCU and a dryer wherein the temperature and moisture content of the clean air (Ao) are adjusted. Then, the cleaned air (Ao) is introduced into the processing chamber 300 via a second clean air supply pipe 326 and a high efficiency filter (not shown) installed in a ceiling of the processing chamber 300.

The air-conditioning system also includes a circulation pipe 320 for providing air (Asp) in the processing chamber 300 to the contamination control apparatus 310. After such secondary air (Asp) is introduced from the processing chamber 300 into the contamination control apparatus 310 through the circulation pipe 320, the secondary air (Asp) is mixed with the primary air (Aic) in the contamination control apparatus 310. Various contaminants are then removed from the mixture of primary and secondary air.

In this case, the ratio of the volume of the secondary air (Asp) to that of the primary air (Aic) introduced into the contamination control apparatus 310 is preferably about 4:6 because the air in the resist spinner is contaminated to a high degree by organic matter.

Figure 8:
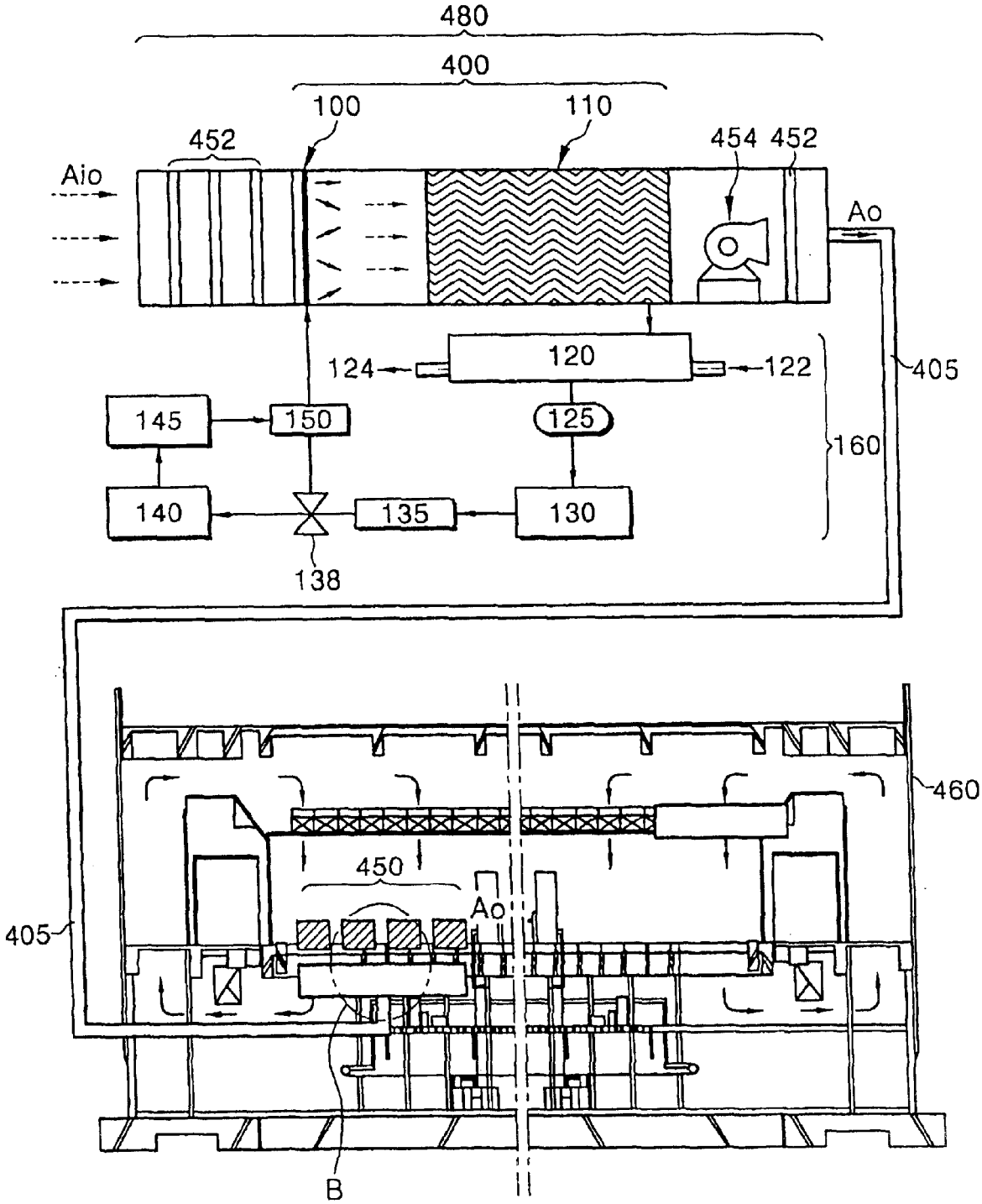
FIG. 8 is a schematic cross-sectional view of still another embodiment of an air-conditioning system of a substrate processing facility according to the present invention.
Figure 9:
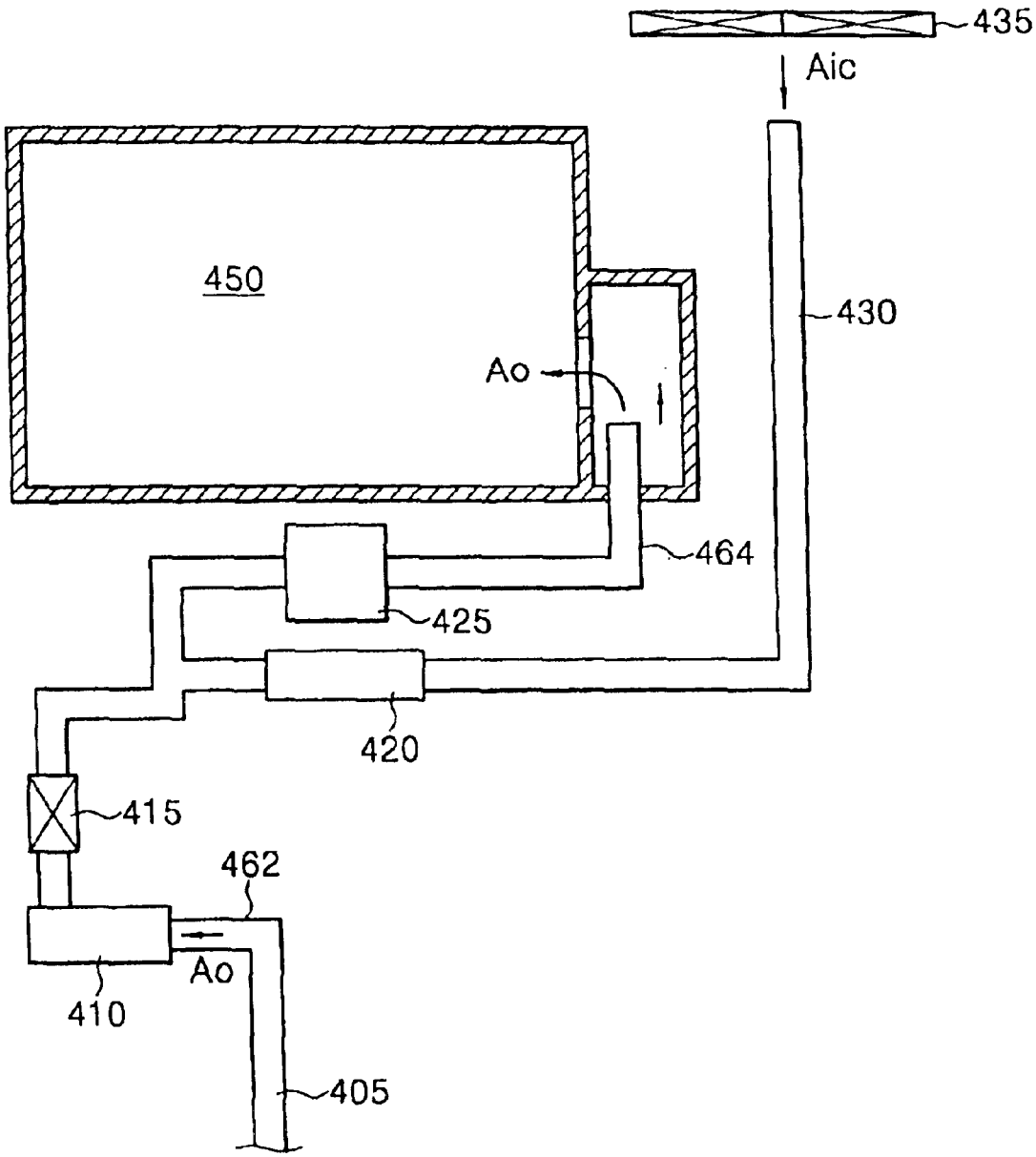
FIG. 9 is an enlarged cross-sectional view of portion "B" of the air-conditioning system illustrated in FIG. 8.

FIGS. 8 and 9 illustrate still another embodiment of an air-conditioning system of a substrate processing facility according to the present invention. This facility is a plant in which a plurality of semiconductor device manufacturing apparatuses or simply, substrate processing apparatuses, are provided. Referring to FIG. 8, the external air-conditioning system 480 includes a plurality of filters 452, a contamination control apparatus 400 and a fan 454.

The contamination control apparatus 400 has a structure substantially identical to that of any of one of the embodiments described above. Basically, then, the contamination control apparatus 400 includes an eliminator 110 in which contaminants are removed, a sprayer 100 for spraying water into the eliminator 110, and a circulator 160 having a pump 125 for continuously providing water, preferably deionized water, to the sprayer 100.

The external air-conditioning system 480 including the contamination control apparatus 400 is installed outside a clean room 460. Clean air (Ao) is directly provided from the external air-conditioning system 480 to the plant, e.g., to several resist processing apparatuses of the plant, through a supply duct 405.

More specifically, dust in the external air (Aio) introduced into the external air-conditioning system 480 is removed using the filters 452, and various contaminants in the external air (Aio) such as ozone, ammonia, sulfuric oxide, nitrous oxide and organic matter are removed using the contamination control apparatus 400. Then, the clean external air (Ao) is induced from the external air-conditioning system 480 into the supply duct 405 by the fan 454.

Referring to FIGS. 8 and 9, the clean external air (Ao) is introduced through the duct 405 into a plurality of inlets 462 connected to the semiconductor device manufacturing apparatuses, respectively. The clean external air (Ao) introduced through the inlets 462 successively passes through a high efficiency filter 415, such as a high efficiency particulate air (HEPA) filter or an ultra low pneumatic air (ULPA) filter, and through a temperature control unit (TCU) 435. The temperature and moisture content of the clean external air (Ao) are adjusted in the TCU 435. Then, the clean air (Ao) is provided into the substrate processing chamber 450 of each substrate processing apparatus through a respective clean air supply pipe 464.

At the same time, air (Aic) circulating in the clean room 460 is filtered using a clean room filter 435 and is induced into the processing chambers 450 through an air supply pipe 430 using a fan 420. Alternatively, the air supply pipe 430 may be connected to the supply duct 405 so that the air (Aic) from the clean room is introduced into the processing chambers 450 after the temperature and/or moisture content of the air (Aic) has been adjusted.

The air (Aic) filtered by the clean room filter 435 generally includes ozone or a minute amount of organic matter as most contaminants, such as ammonia, sulfuric oxide and nitrous oxide have already been removed from the air (Aic). Thus, preferably only about 10 to 20 percent of the entire amount of air directed into the processing chambers 450 is air (Aic) drawn from the clean room 460, whereas the remaining 80 to 90 percent is the cleaned air (Ao) drawn form outside the clean room 460. As a result, the amount of the contaminants introduced into the faciltiy can be minimized. Therefore, the costs of manufacturing semiconductor devices using the facility are also kept relatively low.

Finally, although the present invention has been described with respect to the preferred embodiments thereof, it is noted that modifications of and variations in the preferred embodiments will become readily apparent to persons skilled in the art. It is therefore to be understood that the disclosed embodiments can be modified and varied within the true spirit and scope of the invention as defined by the appended claims.

What is claimed is:

1. A contamination control apparatus comprising:

a sprayer including at least one spray nozzle;

at least one eliminator defining an air flow passageway exposed to said at least one spray nozzle such that air flowing through the passageway will be contacted by spray issuing from said at least one spray nozzle, whereby contaminants are removed from the air; and a circulator connected to said sprayer so as to provide water to the sprayer that is sprayed into said eliminator by said at least one spray nozzle, said circulator including a pH control device that adjusts the pH of the water provided to the sprayer, and an organic matter removing device that removes organic matter from the water provided to the sprayer.

2. The apparatus of claim 1, wherein the pH control device includes an ion exchanger.

3. The apparatus of claim 1, wherein the organic matter removing device includes an organic resin.

4. The apparatus of claim 1, wherein said circulator further comprises a storage tank connected to said eliminator so as to receive water containing contaminants from the eliminator, and a water supply pipe connected to said storage tank separately from the connection between said storage tank and said eliminator such that additional water other than that in said eliminator can be introduced into the storage tank.

5. The apparatus of claim 1, wherein the circulator further comprises a sterilizer that sterilizes the water provided to the sprayer.

6. The apparatus of claim 1, wherein the air flow passageway of said at least one eliminator has a bend in it.

7. The apparatus of claim 1, wherein said at least one eliminator comprises at least two eliminators disposed in series.

8. The apparatus of claim 7, further comprising an additional sprayer interposed between the eliminators, the additional sprayer including at least one spray nozzle.

9. The apparatus of claim 1, wherein said at least one eliminator comprises at least two eliminators disposed in parallel.

10. The apparatus of claim 1, further comprising at least one additional water supply nozzle disposed in said eliminator and oriented to spray water into the air passageway of said eliminator along with that provided by said sprayer.

11. In a substrate processing facility having a clean room, an air-conditioning system comprising:

a substrate processing chamber isolated from the clean room;

air supply piping connected to said substrate processing chamber and open to the interior of said clean room so as to introduce primary air from the clean room into the substrate processing chamber;

a contamination control apparatus connected to said air supply piping upstream of said substrate processing chamber so as to receive the primary air from said clean room, the contamination control apparatus including a sprayer including at least one spray nozzle, at least one eliminator defining an air flow passageway exposed to said at least one spray nozzle and to said air supply piping such that the primary air will flow through the passageway and will be contacted by spray issuing from said at least one spray nozzle, whereby contaminants are removed from the primary air, and a circulator connected to said sprayer so as to provide water to the sprayer that is sprayed into said eliminator by said at least one spray nozzle, said circulator including a pH control device that adjusts the pH of the water provided to the sprayer, and an organic matter removing device that removes organic matter from the water provided to the sprayer; and clean air supply piping connecting the air flow passageway of said eliminator to said processing chamber such that clean air is introduced from said contamination control apparatus to said substrate processing chamber.

12. The air-conditioning system of a substrate processing facility of claim 11, further comprising a clean air control unit that is connected to said clean air supply piping and is operable to regulate at least one of the temperature and humidity of the clean air supplied to said substrate processing chamber.

13. The air-conditioning system of a substrate processing facility of claim 11, further comprising circulation piping connecting said substrate process chamber to said contamination control apparatus at an upstream side of the air passageway of said eliminator such that secondary air in said substrate processing chamber is fed into the contamination control apparatus.

14. The air-conditioning system of a substrate processing facility of claim 11, wherein said circulator further comprises a storage tank connected to said eliminator so as to receive water containing contaminants from the eliminator, and a water supply pipe connected to said storage tank separately from the connection between said storage tank and said eliminator such that additional water other than that in said eliminator can be introduced into the storage tank.

15. The air-conditioning system of a substrate processing facility of claim 11, wherein the air flow passageway of said at least one eliminator has a bend in it.

16. The air-conditioning system of a substrate processing facility of claim 11, wherein said at least one eliminator comprises at least two eliminators disposed in series.

17. The air-conditioning system of a substrate processing facility of claim 16, further comprising an additional sprayer interposed between the eliminators, the additional sprayer including at least one spray nozzle.

18. The air-conditioning system of a substrate processing facility of claim 11, wherein said at least one eliminator comprises at least two eliminators disposed in parallel.

19. The air-conditioning system of a substrate processing facility of claim 11, further comprising at least one additional water supply nozzle disposed in said eliminator and oriented to spray water into the air passageway of said eliminator along with that provided by said sprayer.

20. A substrate processing facility comprising:

a clean room;

a plurality of substrate processing apparatuses disposed in said clean room, each of said apparatuses having a respective chamber in which substrates are processed;

an external air-conditioning system having a contamination control apparatus disposed outside said clean room, the contamination control apparatus including a sprayer including at least one spray nozzle, at least one eliminator defining an air flow passageway exposed to said at least one spray nozzle such that the primary flowing through the passageway will be contacted by spray issuing from said at least one spray nozzle, whereby contaminants are removed from the primary air, and a circulator connected to said sprayer so as to provide water to the sprayer that is sprayed into said eliminator by said at least one spray nozzle, said circulator including a pH control device that adjusts the pH of the water provided to the sprayer, and an organic matter removing device that removes organic matter from the water provided to the sprayer, a clean air supply duct leading from said contamination control apparatus at a downstream side of said eliminator into said clean room and connected to the chambers of said substrate processing apparatuses so that air cleaned by said contamination control apparatus is supplied to said substrate processing apparatuses; and a filter disposed in said duct so as to filter the clean air flowing from said contamination control apparatus to said substrate processing apparatuses.

21. The substrate processing facility of claim 20, further comprising a clean air control unit that is connected to said clean air supply duct and is operable to regulate at least one of the temperature and humidity of the clean air supplied to said substrate processing apparatuses.

22. The substrate processing facility of claim 20, further comprising a plurality of air supply pipes connected to the substrate processing apparatuses and open to the interior of said clean room so as to introduce air in the clean room into the processing chambers.

23. The substrate processing facility of claim 20, wherein said circulator further comprises a storage tank connected to said eliminator so as to receive water containing contaminants from the eliminator, and a water supply pipe connected to said storage tank separately from the connection between said storage tank and said eliminator such that additional water other than that in said eliminator can be introduced into the storage tank.

24. The substrate processing facility of claim 20, wherein the air flow passageway of said at least one eliminator has a bend in it.

25. The substrate processing facility of claim 20, wherein said at least one eliminator comprises at least two eliminators disposed in series.

26. The substrate processing facility of claim 25, further comprising an additional sprayer interposed between the eliminators, the additional sprayer including at least one spray nozzle.

27. The substrate processing facility of claim 20, wherein said at least one eliminator comprises at least two eliminators disposed in parallel.

28. The substrate processing facility of claim 20, further comprising at least one additional water supply nozzle disposed in said eliminator and oriented to spray water into the air passageway of said eliminator along with that provided by said sprayer.

29. A method of conditioning air used in the processing of a substrate within a designated space, said method comprising:

directing primary air from outside the processing chamber, and containing potential contaminants with respect to the processing of a substrate, into a passageway to create a flow of the air in the passageway;

feeding water to at least one spray nozzle and spraying the flow of air with the water from the at least one spray nozzle, whereby the water absorbs contaminants in the air;

measuring the pH of the water before it is fed to the at least one spray nozzle;

adjusting the pH of the water if the measured pH is outside a set range;

treating the water, before it is fed to the at least one spray nozzle, to remove organic matter from the water before it is sprayed onto the flow of air; and directing the air, once it has been sprayed with the water from the at least one spray nozzle, into a substrate processing chamber sealed from the environment external to the chamber.

30. The method of claim 29, further comprising collecting in a storage tank the water that has been sprayed onto the flow of air, wherein said feeding of the water to the at least one spray nozzle includes circulating the water from the storage tank back to the at least one spray nozzle, and introducing additional water into the storage tank separately from that which is collected in the tank after having been sprayed onto the flow of air.

31. The method of claim 30, wherein said introducing additional water into the storage tank comprises introducing an amount of water that is equal to 10% of that being collected in the tank after having been sprayed onto the flow of air.

32. The method of claim 30, further comprising sterilizing the water fed from the storage tank to the at least one spray nozzle.

33. The method of claim 29, wherein the creating a flow of air in the passageway comprises inducing a vortex in the air such that the air swirls in the passageway as it is sprayed with water from the at least one spray nozzle.

34. The method of claim 29, further comprising directing secondary air from the processing chamber into the passageway along with the primary air containing the potential contaminants, whereby both the primary and secondary air is sprayed with water from the at least one spray nozzle.

35. The method of claim 34, wherein the substrate is coated with a resist in the processing chamber, and wherein said directing of secondary air comprises directing into the passageway an amount of the secondary air that constitutes only about 40% of the total volume of the primary and secondary air that is directed into the passageway.

36. The method of claim 34, wherein the process chamber is disposed within a clean room, and wherein the primary air directed into the passageway is drawn from outside the clean room, and the secondary air directed into the passageway is drawn from within the clean room, and the ratio of the volume of the secondary air directed into the passageway to that of the primary air directed into the passageway is between about 8:2 to 9:1.

37. The method of claim 29, further comprising measuring at least one of the temperature and moisture content of the air once it has been sprayed with water, and adjusting the at least of the temperature and moisture content of the air if the at least one of the temperature and moisture content of the air is outside a set range.

38. The method of claim 29, wherein said spraying the flow of air with the water from the at least one spray nozzle comprises spraying the flow of air with water having a hexagonal molecular structure.

* * * * *